US006102222A

United States Patent [19]

Wurzer et al.

[11] Patent Number: 6,102,222

[45] Date of Patent: Aug. 15, 2000

[54] LIGHTWEIGHT DRAWBAR ASSEMBLY

[75] Inventors: Jeffrey D. Wurzer, Turtle Creek; Shawn A. Opfer, Pittsburgh, both of Pa.

[73] Assignee: McConway & Torley Corporation, Pittsburgh, Pa.

[21] Appl. No.: 09/154,792

[22] Filed: Sep. 17, 1998

[51] Int. Cl.[7] ..... B61G 9/20

[52] U.S. Cl. ..... 213/62 R; 213/50; 213/61; 213/62 A

[58] Field of Search ..... 213/62 R, 69, 213/72, 50, 50.5, 61, 75 R, 62 A, 67 A, 67 R

[56] References Cited

U.S. PATENT DOCUMENTS

| | | | |
|---|---|---|---|
| 4,456,133 | 6/1984 | Altherr et al. | 213/62 R |
| 4,580,686 | 4/1986 | Elliott | 213/62 A |
| 5,201,827 | 4/1993 | Glover et al. | 213/61 |
| 5,558,238 | 9/1996 | Daugherty et al. | 213/50.5 |
| 5,598,937 | 2/1997 | Clark | 213/62 R |

*Primary Examiner*—S. Joseph Morano
*Assistant Examiner*—Lars A. Olson
*Attorney, Agent, or Firm*—James Ray & Associates

[57] ABSTRACT

A slackless drawbar coupler assembly for use in combination with a railway car having a center sill wherein the drawbar has a shank portion extending to an enlarged truncated butt end portion defining essentially a convex, hemispherical buff load bearing surface, with an aperture at the axis of the hemispherical buff load bearing surface, and includes a rear support block having a concave hemispherical buff load bearing surface on one side adapted to engage the convex, hemispherical buff load bearing surface on the drawbar. A spool for supporting an end of the drawbar is provided which is a generally rectangular sleeve-like body having a first pair of horizontally disposed and parallel side wall members transverse to a second pair of vertically disposed and parallel top and bottom wall members, such that a drawbar pivot pin is disposed through the aperture in the drawbar, the ends of which are secured within aligned apertures in one of the pair of horizontally disposed and parallel wall members of the spool to permit pivotal motion of the drawbar on the pivot pin, while a support housing securable to the center sill of the railway car is provided for pivotally supporting the spool within rectangular cavity on an axis perpendicular to the drawbar pivot pin.

20 Claims, 4 Drawing Sheets

LIGHTWEIGHT DRAWBAR ASSEMBLY

FIELD OF THE INVENTION

The present invention relates, in general, to a drawbar assembly for interconnecting railway cars, and more particularly, to a new and improved lightweight, slackless drawbar assembly which is lighter in weight and yet stronger than prior art slackless drawbar assemblies. The drawbar assembly of this invention utilizes a unique spool arrangement having perpendicular pivot pins which functions much like a universal joint to make the pivotal interconnection virtually slack free with a minimum of frictional forces.

CROSS REFERENCE TO RELATED APPLICATIONS

The invention taught in this patent application is closely related to the inventions taught in four co-pending patent applications, namely: SPOOL FOR LIGHTWEIGHT DRAWBAR ASSEMBLY, Ser. No. 09/156,304, BEARING BLOCK FOR LIGHTWEIGHT DRAWBAR ASSEMBLY, Ser. No. 09/154,852, DRAWBAR FOR LIGHTWEIGHT DRAWBAR ASSEMBLY, Ser. No. 09/156,542, SUPPORT HOUSING FOR LIGHTWEIGHT DRAWBAR ASSEMBLY, Ser. No. 09/154,610, all of which are being filed concurrently herewith. These patent applications are assigned to the assignee of this invention, and the teachings therein are incorporated into this application by reference thereto.

BACKGROUND OF THE INVENTION

In 1932, the Type E coupler was adopted as the ARA, American Railway Association (predecessor to the AAR, Association of American Railroads) standard coupler for railway freight cars. Although modified periodically since then to meet changing requirements imposed by changing demands, and other coupler designs have been developed for special applications, the Type E coupler is today still the standard coupler for freight service. As is well known, the Type E coupler as well as other standard use couplers, have a degree of free and cushioned slack. That is, a certain amount of free "play" exists between the coupler components when the load is changed from draft to buff loading, and visa versa. At the same time, the draft gear acts as a spring mechanism to cushion impact between adjacent cars. It has been found that eliminating the free and cushioned slack within a train can eliminate over the road train action forces due to "run-ins" and "run-outs". The magnitude of these forces are large and cause significant wear and tear of the rolling stock, and in some cases can be significant enough to cause derailments.

More recently, slackless drawbar coupler have come into use which were developed for use in unit train applications where interconnected cars are uncoupled only rarely for periodic inspection and repair, with the coupling essentially comprising a rigid drawbar with one end pivotally connected to one car and the other end pivotally connected to the adjacent car. Such jointed cars are not subjected daily to impact forces associated with bumping encountered in classification yards, and, therefore, do not require cushioning devices such as draft gears. Accordingly, because of their significant lighter weight, such slackless drawbar couplers are in widespread use in unit trains, such as coal trains, and other captive use applications.

An example of such a slackless drawbar coupling is disclosed in U.S. Pat. No. 4,580,686, the disclosure of which is incorporated herein by reference. This patented coupling system provides a drawbar arrangement for coupling railway cars each having a center sill and trucks at its opposite ends, the trucks being pivotal about vertical king pins. The drawbar has an enlarged spherical butt end portion defining essentially convex spherical buff and draft load surfaces, a rear support block having a tapered rear surface and a concave substantially hemispherical buff load bearing surface adapted to engage with the convex buff load bearing surface of the butt end portion of the drawbar, a slack adjusting wedge for engaging the tapered surface of the rear support block, means for transferring buff loads from the slack adjusting wedge to the center sill, a front draft block having a concave and substantially hemispherical draft load bearing surface adapted to engage with the convex draft load surface of the enlarged spherical butt end portion, the front draft block including an annular draft load surface opposite the hemispherical draft load surface thereof, a wear block having an annular draft load surface adapted to engage the annular draft load surface of the front draft block, and means supported by the center sill for transferring a draft load from the wear block to the center sill. Although there are other slackless drawbar designs, most can be divided into two basic types, those in which the drawbar is rotary, as described above where the drawbar has a spherical head portion, and those where the drawbar is not rotary, as for example, where the end of the drawbar is secured with a single pivot pin securing it to a base structure.

SUMMARY OF THE INVENTION

This invention offers to the art a new and improved slackless drawbar system which meet all AAR specifications, is significantly lighter in weight and yet stronger than prior art drawbar systems, and is virtually slack free. This inventive new drawbar system is a non-rotary type utilizing a unique yoke structure which provides perpendicular pivot pins to function much like a universal joint to thereby minimize structural mass, simplify casting and machining requirements and virtually rendering the coupling slack free by eliminating spherical and hemispherical draft load interfaces.

In essence, the unique and improved slackless drawbar system of this invention, like others, is adapted for use in combination with railway cars having a center sill, and is incorporated into an end of such center sill. The assembly itself includes a drawbar having a shank portion extending to an enlarged truncated butt end portion defining essentially a convex, partial hemispherical buff load bearing surface, with an aperture at the axis thereof, with the shank portion projecting from the convex, partial hemispherical buff load bearing surface. A rather unique spool is utilized for supporting an end of the drawbar which comprises a generally rectangular sleeve-like structure having a first pair of vertically disposed and parallel side wall members transverse to a second pair of horizontally disposed and parallel top and bottom wall members. The spool is further provided with a first pair of axially aligned apertures centrally disposed in the first pair of horizontally disposed, and parallel top and bottom wall members which are adapted to cooperatively receive a drawbar pivot pin, and a second pair of axially aligned apertures centrally disposed in the second pair of vertically disposed and parallel side wall members, each adapted to receive an interlocking disk-pin for pivotally connecting the spool to a support housing.

The support housing is securable to the center sill of a railway car and includes a rectangular cavity in an outer rear end adapted to receive the spool, with the rectangular cavity having opposed and aligned apertures in opposed side walls thereof, each adapted to receive an interlocking disk-pin such that the spool is pivotally attached within the cavity of the support housing for pivotal movement in a vertical plane on the horizontally disposed interlocking disk-pins. A drawbar pivot pin is secured within the first pair of axially aligned apertures in the spool and extends through the aperture through the drawbar such that the drawbar is pivotally attached to the pivot pin for pivotal movement in a horizontal plane. As in other slackless drawbar designs, a gravity activated, slack adjusting wedge is disposed between a rear support block and a side surface of the cavity in the support housing which is adapted to bias the rear support block against the convex partial hemispherical buff load bearing surface of the drawbar.

Another rather unique aspect is the provision of a generally rectangular aperture through the drawbar at which the drawbar is pivotal, by providing a bearing block disposed within the generally rectangular aperture having a half-cylindrical surface on one side adapted to engage against the drawbar pivot pin, and a generally rectangular surface on an opposite side adapted to abut against a flat side of the rectangular aperture to bias the bearing block against the drawbar pivot pin.

OBJECTS OF THE INVENTION

It is, therefore, one of the primary objects of the present invention to provide a new, improved and light weight drawbar assembly for use in combination with a railway car having a center sill.

Another object of the present invention is to provide a new and improved light weight drawbar assembly which is not only lighter in weight than comparable prior art assemblies, but is also stronger and virtually slack free.

Still another object of the present invention is to provide a new and improved light weight drawbar assembly that utilizes a unique spool arrangement which functions much like a universal joint, which in combination with a gravity wedge having an elastomeric surface, will virtually eliminate all slack within the coupling.

A further object of this invention is to provide a new and improved light weight drawbar assembly that does not include any spherical or hemispherical draft load bearing surfaces.

In addition to the above-identified objects and advantages of the present invention, various other objects and advantages of such invention will become more readily apparent to those persons who are skilled in the railway coupling art from the following more detailed description of the invention, particularly, when such description is taken in conjunction with the attached drawing figures and with the appended claims.

DESCRIPTION OF A PREFERRED EMBODIMENT OF THE INVENTION

Figure 1:
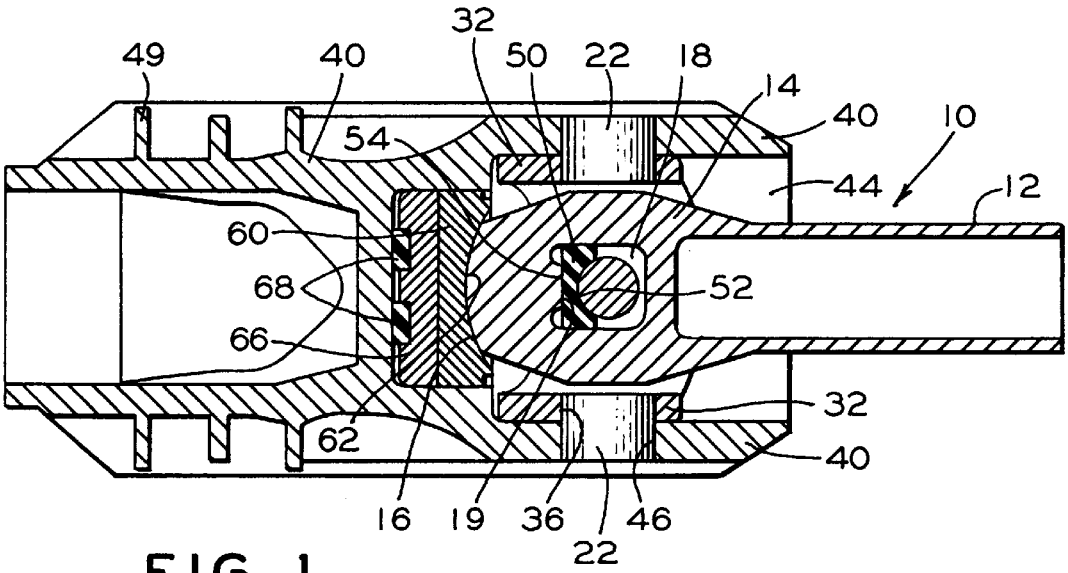
FIG. 1 is a partial cross-sectional plan view of the drawbar coupler assembly in accordance with a preferred embodiment of this invention, with the section taken through the horizontal mid-point of the structure.

Prior to proceeding with a more detailed description of the invention it should be noted that, for the sake of clarity, identical components having identical functions have been identified with identical reference numerals throughout the several views of the drawings.

Figure 2:
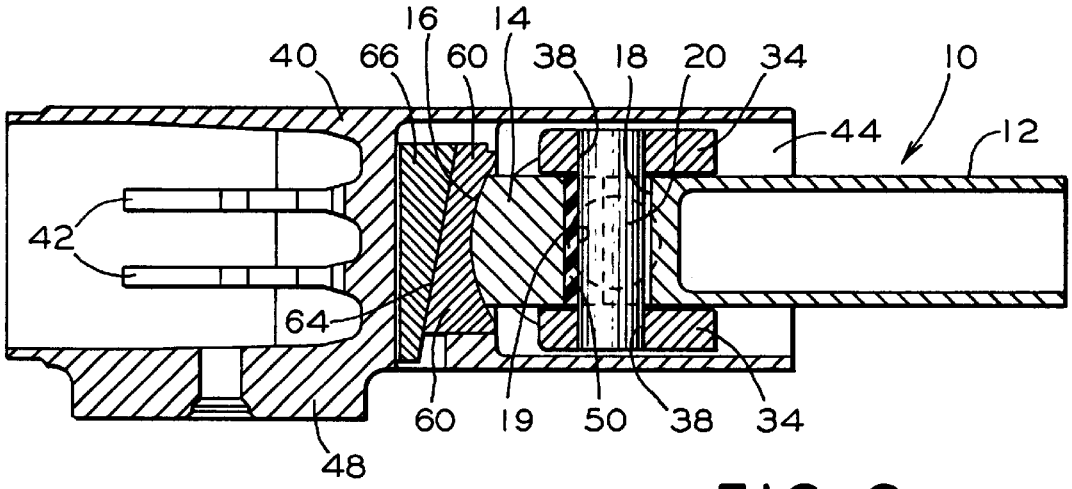
FIG. 2 is a cross-sectional side view of the structure as illustrates in FIG. 1, with the section taken through the vertical mid-point of the structure.
Figure 3:
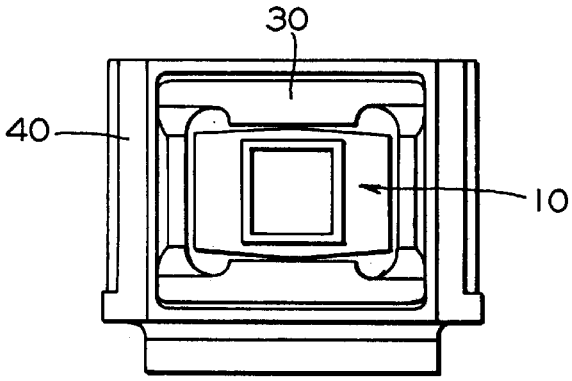
FIG. 3 is an end view of the structure as illustrated in FIGS. 1 and 2.
Figure 4:
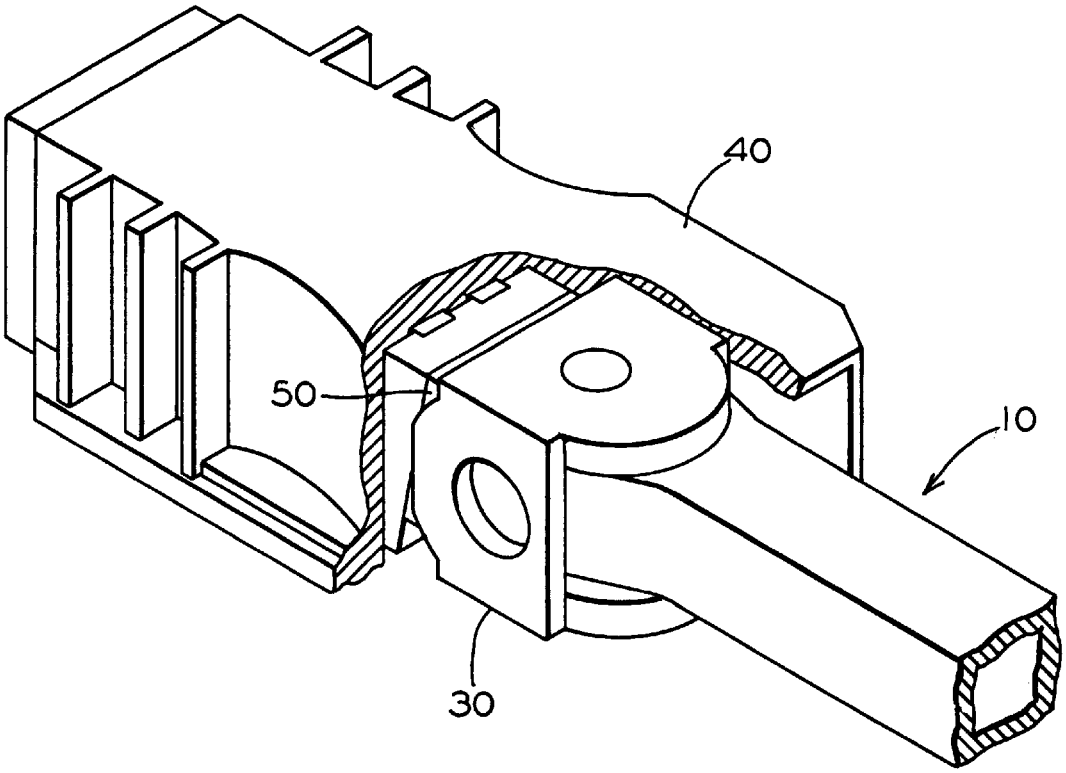
FIG. 4 is a partial isometric view of the drawbar assembly illustrated in FIGS. 1–3.
Figure 5:
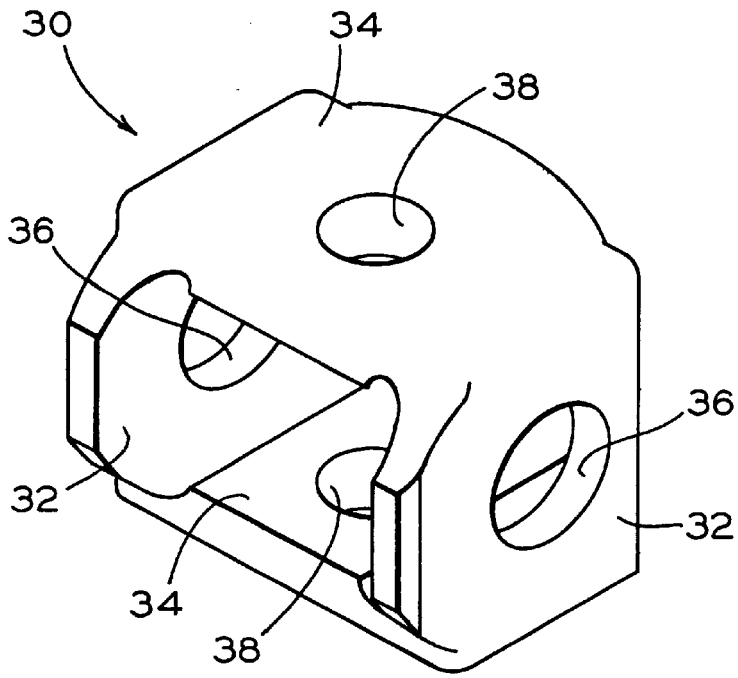
FIG. 5 is an isometric view of the unique spool shown in FIGS. 1–3.
Figure 6:
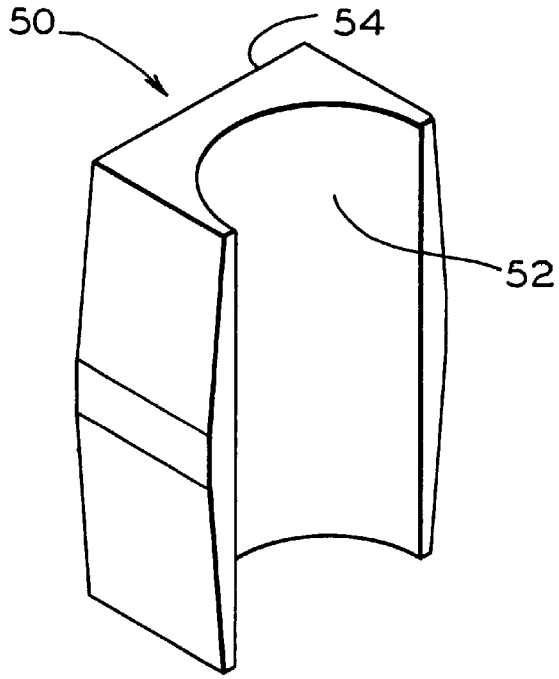
FIG. 6 is an isometric view of the bearing block shown in FIGS. 1–3.
Figure 7:
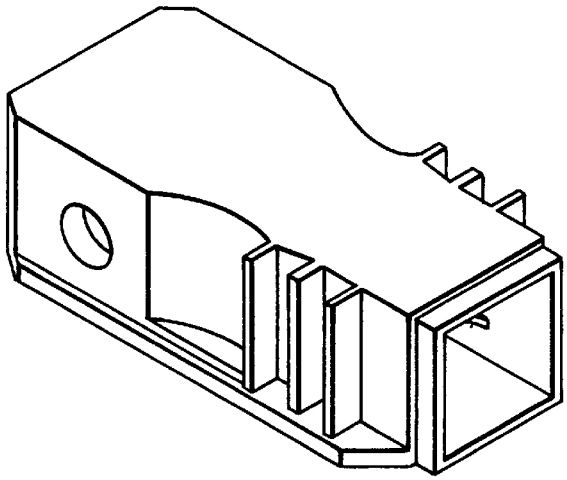
FIG. 7 is an isometric view of the unique support housing as shown in FIGS. 1–3.
Figure 8:
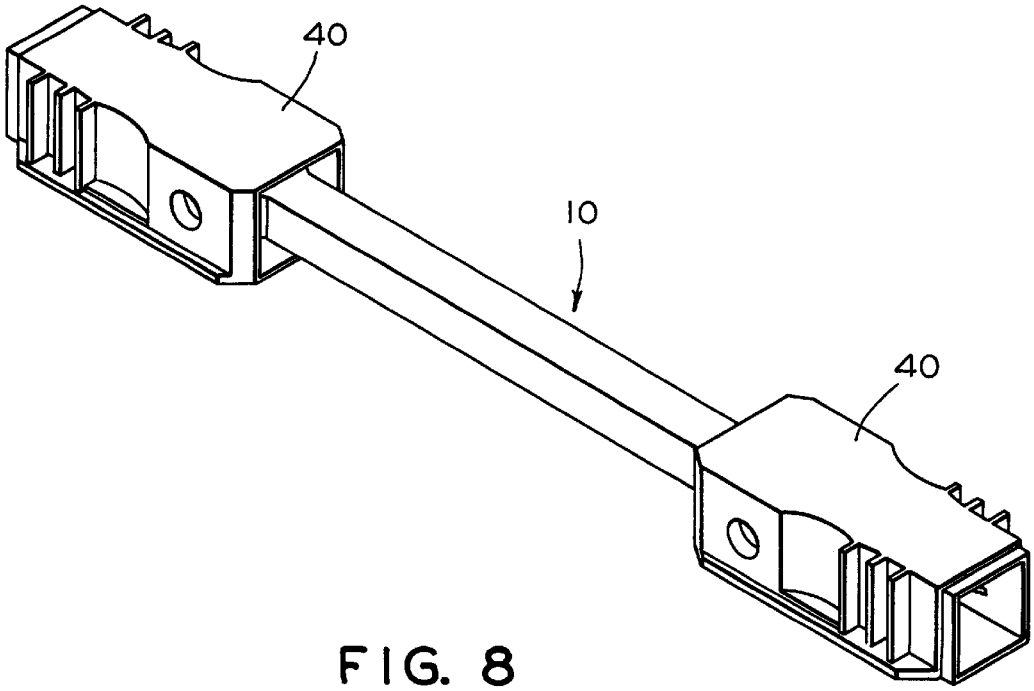
FIG. 8 is an isometric view of a completed system showing a drawbar as interconnected between a pair of coupled assemblies.

Referring to the attached figures, and particularly FIGS. 1–3, a presently preferred embodiment of the slackless drawbar assembly of this invention is illustrated and comprises an elongated drawbar 10 having a shank portion 12 extending to an enlarged truncated butt end portion 14, defining essentially a convex, hemispherical buff load bearing surface 16, and having a generally rectangular aperture 18 at the axis of the hemispherical buff loading bearing surface 16. As can be seen, the shank portion 12 projects forwardly from the convex, hemispherical buff load bearing surface 16. While the drawbar 10 is shown to be generally rectangular in cross-section, other cross-sectional forms would work as well. Although the buff load bearing surface 16 is hemispherical, it is clear that it is not a full hemisphere, in that it is limited by the rectangular side edges of the drawbar 10. Accordingly, while a fuller hemispherical form could be utilized if desired, such would merely add unnecessary weight and mass to the drawbar 10. As shown in FIG. 4, the drawbar 10 is preferably hollow for purposes of weight saving without sacrificing strength. As shown in the FIG. 3, the generally flat outer surface edges of the butt end portion 14 are preferably tapered downwardly by a small degree to assure that such edges do not bind on the edged surfaces of the spool 30, described below, into which drawbar 10 is pivotally pinned.

A unique spool 30 is provided or supporting an end of drawbar 10, which spool 30 comprises a generally rectangular sleeve-like body having a first pair of parallel side wall members 32 vertically extending from a second pair of parallel, horizontally disposed top and bottom wall members 34. Hence, wall members 32 and 34 essentially define a box-like sleeve body with both horizontal ends open, into which an end of drawbar 10 is inserted. A first pair of axially aligned apertures 36 are disposed through the first pair of parallel, vertically disposed, side wall members 32 each of which is adapted to receive an interlocking disk member 22 for pivotally connecting spool 30 to a support housing 40 described below. A second pair of axially aligned apertures 38 are disposed in the second pair of parallel, horizontally disposed, top and bottom wall members 34, which are adapted to receive a drawbar pivot pin 20. As shown in FIG. 3, the inside intersecting corners of wall members 32 and 34 are preferably recessed to assure a flat surface that will not cause binding of the edges of drawbar 10 as it pivots within spool 30, as well as preventing any stress risers that could be created by any right angle intersecting members.

A support housing 40, adapted to support the entire drawbar assembly, is securable to the center sill (not shown) of a railway car (not shown) by any technique such as welding. The support housing 40 is provided with elongated reinforcing ribs 42 behind a rectangular cavity 44 in the outer end thereof, which cavity 44 is adapted to receive and pivotally retain spool 30. The dimensions of cavity 44 must be sufficient to contain spool 30 and to permit some pivotal movement of spool 30 in a vertical plane. Cavity 44 is provided with a pair of axially aligned apertures 46 in the vertical side walls which apertures 46 are aligned with the first pair of axially aligned apertures 36 disposed in the first pair of vertically disposed, parallel side wall members 32 of spool 30. As was noted above, each aperture 36 is adapted to receive an interlocking disk member 22 for pivotally connecting spool 30 to the support housing 40. Hence each interlocking disk member 22 is disposed through an aperture 46 in support housing 40 and the adjacent, mating aperture 36 in spool 30, such that spool 30 is pivotal in a vertical plane on the interlocking disk members 22. Accordingly, the two interlocking disk members 22, although spaced apart, are axially aligned to function as would a single pin. As can be seen by contrasting FIGS. 1 and 2, the side walls of cavity 44 are closely spaced, but not so closely spaced as to prevent vertically disposed, wall members 34 on spool 30 from pivotal movement on disk members 22. The top and bottom side walls of cavity 44 are spaced significantly more to permit some pivotal movement of wall members 32 on spool 30, otherwise, spool 30 would not be pivotal on interlocking disk members 22. Although not material for the purposes of this invention, support housing 40 is further provided with a center plate 48 protruding downwardly from the underside to which a bolster (not shown) it to be rotatably attached, and a plurality of laterally extending vertical flanges 49, which are utilized to facilitate welding of the car structure (not shown) to the support housing 40.

The above described drawbar 10 is secured within spool 30 by inserting the butt end portion 14 through the rearward rectangular opening of spool 30 such that rectangular aperture 18 through drawbar 10, will be aligned with apertures 38 extending through the parallel, horizontally disposed, top and bottom wall members 34 on spool 30. Accordingly, drawbar pivot pin 20, inserted within aligned apertures 38, will also extend through rectangular aperture 18 in drawbar 10.

Drawbar 10 is pivotally secured to pivot pin 20 by a bearing block 50 having a concave, half-cylindrical surface 52 on one side, adapted to engage against a side of drawbar pivot pin 20, and a generally flat surface 54 on the opposite side, which is disposed within generally rectangular aperture 18, such that generally flat surface 54 is disposed against a flat forward surface 19 of rectangular aperture 18, to thereby bias half cylindrical surface 52 against drawbar pivot pin 20. As can be seen, the outward corners of aperture 18 in drawbar 10, are preferably recessed to assure a flat surface 19 is provided, against which bearing block 50 is to be abutted, as well as assuring that stress risers are not created at the intersecting corners.

A rear support block or follower 60, having a concave, hemispherical, buff load bearing surface 62 on one side, opposite a flat angled surface 64 on the other side, is vertically disposed within rectangular cavity 44 of support housing 40, such that concave, hemispherical buff load bearing surface 62 is engaged against convex, hemispherical buff load bearing surface 16 on drawbar 10. As in many comparable prior art drawbar assemblies, a gravity activated, slack adjusting wedge 66 is disposed between a rear end wall of rectangular cavity 44 and the adjacent flat, angled surface 64 of rear support block 60. Accordingly, gravitational forces tending to pull gravity wedge 66 downwardly within cavity 44, will serve to bias gravity wedge 66 against rear support block 60, and accordingly bias concave, hemispherical buff load bearing surface 62 against its convex counter part on drawbar 10.

Preferably, gravity wedge 66 is provided with a biasing surface of an elastomeric material, which as shown, preferably comprises a pair of elongated elastomeric strips 68 vulcanized within a pair of vertical recesses on the rearward facing surface of gravity wedge 66, such that the elastomeric strips will be in contact with the flat end wall of rectangular cavity 44.

As should be apparent from the above description, all buff loading through the system will be from the drawbar 10 through interfacing hemispherical surfaces between drawbar 10 and rear support block 60 and the interfacing surfaces of the elastomeric material on gravity wedge 66 with the rear wall of rectangular cavity 44, and through the attachment of support housing 40 to the center sill (not shown) of the railway car. On the other hand, all draft loading will be transmitted from the drawbar 10 through bearing block 50 and drawbar pivot pin 20, through spool 30 and through interlocking disk members 22 and support housing 40 to the center sill of the railway car. Accordingly, in draft loading the above disclosed system does not rely on any spherical or hemispherical friction bearing surfaces.

While a presently preferred embodiment of the present invention has been described in detail above, it should be understood that persons skilled in the art may make various other modifications and adaptations of the invention without departing from the spirit or scope of the appended claims. For example, while the rectangular aperture 18 in drawbar 10 in combination with bearing block 50, is believed to be ideal in that only draft loading is achieved through the intersecting components, it is obvious that a more conventional cylindrical bushing could be provided within a circular aperture. In addition, a more conventional gravity wedge, not having an elastomeric surface, could be utilized if desired, but with some sacrifice in performance in the slackless characteristics. While it is believed that the disclosed relationships are ideal, it should also be apparent that the relative positions of the drawbar pivot pin 20 and the interlocking disk members 22 could be reversed so that spool 30 is pivotal in a horizontal plane and the drawbar 10 pivotal in a vertical plane. Accordingly, it should be apparent that a number of other embodiments and modification could also be made without departing from the spirit of the invention.

We claim:

1. A slackless drawbar coupler assembly for use in combination with a railway car having a center sill, said assembly comprising:

a drawbar having a shank portion extending to an enlarged truncated butt end portion defining essentially a convex, hemispherical buff load bearing surface, with an aperture at the axis of said hemispherical buff load bearing surface, said shank portion projecting from said convex, hemispherical buff load bearing surface;

a rear support block having a concave hemispherical buff load bearing surface on one side thereof adapted to engage said convex, hemispherical buff load bearing surface on said drawbar;

a spool for supporting an end of said drawbar comprising a generally rectangular sleeve-like body having a first pair of vertically disposed and parallel side wall members transverse to a second pair of horizontally disposed and parallel top and bottom wall members;

a drawbar pivot pin disposed through said aperture in said drawbar, the ends of which are secured within aligned apertures in one of said pair of parallel wall members of said spool to permit pivotal motion of said drawbar on said pivot pin;

a support housing securable to such center sill of such railway car for supporting said spool, said support housing having a rectangular cavity in an outer end adapted to pivotally receive said spool on a pivotal axis perpendicular to said drawbar pivot pin;

a gravity activated, slack adjusting wedge disposed between said rear support block and an end surface of said cavity in said support housing adapted to bias said concave hemispherical buff load bearing surface on said rear support block against said convex hemispherical buff load bearing surface on said drawbar.

2. A slackless drawbar coupler assembly, according to claim 1, in which said aperture in said drawbar is generally rectangular, and a bearing block is provided within said generally rectangular aperture having a half-cylindrical surface on one side adapted to engage against said drawbar pivot pin, and a flat surface on an opposite side adapted to abut against a flat side surface of said generally rectangular aperture in said drawbar to bias said half-cylindrical surface on said bearing block against said drawbar pivot pin.

3. A slackless drawbar coupler assembly, according to claim 1, in which said gravity activated, slack adjusting wedge is provided with an elastomeric surface on one side surface disposed between said rear support block and a side surface of said cavity in said support housing.

4. A slackless drawbar coupler assembly, according to claim 3, in which said elastomeric surface comprises at least one strip of elastomeric material vulcanized within a vertically disposed recess on the rearward facing surface of said gravity wedge, such that the elastomeric strip will be in contact with the flat end wall of said generally rectangular cavity in said support housing.

5. A slackless drawbar coupler assembly, according to claim 1, in which said rear support block is provided with a flat surface opposite said concave hemispherical buff load bearing surface.

6. A slackless drawbar coupler assembly, according to claim 5, in which said flat surface opposite said concave hemispherical buff load bearing surface is an angled flat surface the angle of which is adapted to mate with an adjacent angled surface on said gravity activated, slack adjusting wedge.

7. A slackless drawbar coupler assembly, according to claim 5, in which said shank portion of said drawbar is hollow and has a generally rectangular cross-section.

8. A slackless drawbar coupler assembly for use in combination with a railway car having a center sill, said assembly comprising:

a drawbar having a shank portion extending to an enlarged truncated butt end portion defining essentially a convex, hemispherical buff load bearing surface, with an aperture at the axis of said hemispherical buff loading bearing surface, said shank portion projecting from said convex, hemispherical buff load bearing surface;

a rear support block having a concave hemispherical buff load bearing surface on one side thereof adapted to engage said convex, hemispherical buff load bearing surface on said drawbar, and having a flat surface opposite said concave hemispherical buff load bearing surface;

a spool for supporting an end of said drawbar comprising a generally rectangular sleeve-like body having a first pair of horizontally disposed and parallel side wall members transverse to a second pair of vertically disposed and parallel top and bottom wall members;

a first pair of axially aligned apertures centrally disposed through said first pair of vertically disposed and parallel side wall members each adapted to receive an interlocking disk-pin for pivotally connecting said spool to a support housing;

a second pair of axially aligned apertures centrally disposed through said second pair of horizontally disposed and parallel top and bottom wall members, adapted to receive a drawbar pivot pin;

a support housing securable to such center sill of such railway car for supporting said spool, said support housing having a rectangular cavity in an outer end adapted to receive said spool, said rectangular cavity having opposed and aligned apertures in opposed vertically disposed side walls thereof, each adapted to receive a said interlocking disk-pin such that said spool is pivotally attached within said cavity for pivotal movement in a vertical plane on said horizontally disposed interlocking disk-pins;

a drawbar pivot pin disposed within said second pair of axially aligned apertures in said top and bottom wall members of said spool and extending through said aperture through said drawbar such that said drawbar is pivotally attached to said pivot pin;

a gravity activated, slack adjusting wedge disposed between said rear support block and an end surface of said cavity in said support housing adapted to bias said concave hemispherical buff load bearing surface on said rear support block against said convex hemispherical buff load bearing surface on said drawbar.

9. A slackless drawbar coupler assembly, according to claim 8, in which said aperture in said drawbar is generally rectangular, and a bearing block is provided within said generally rectangular aperture having a half-cylindrical surface on one side adapted to engage against said drawbar pivot pin, and a generally rectangular surface on an opposite side adapted to abut against a flat side surface of said generally rectangular aperture in said drawbar to bias said half-cylindrical surface on said bearing block against said drawbar pivot pin.

10. A slackless drawbar coupler assembly, according to claim 8, in which said gravity activated, slack adjusting wedge is provided with an elastomeric surface on one side surface disposed between said rear support block and a side surface of said cavity in said support housing.

11. A slackless drawbar coupler assembly, according to claim 10, in which said elastomeric surface comprises at least two strips of elastomeric material vulcanized within a vertically disposed recess on the rearward facing surface of gravity wedge 66, such that the elastomeric strips will be in contact with the flat end wall of rectangular cavity.

12. A slackless drawbar coupler assembly, according to claim 8, in which said flat surface opposite said concave hemispherical buff load bearing surface is an angled flat surface the angle of which is adapted to mate with an adjacent angled surface on said gravity activated, slack adjusting wedge.

13. A slackless drawbar coupler assembly, according to claim 8, in which said shank portion of said drawbar is hollow and has a generally rectangular cross-section.

14. A slackless drawbar coupler assembly for use in combination with a railway car having a center sill, said assembly comprising:

a drawbar having a shank portion extending to an enlarged truncated butt end portion defining essentially a convex hemispherical buff load bearing surface, with a generally rectangular, vertically oriented aperture at the axis of said hemispherical buff load bearing surface, the shank portion projecting from said convex hemispherical buff load bearing surface, a rear support block having a concave hemispherical buff load bearing surface on one side thereof adapted to engage said convex, hemispherical buff load bearing surface on said drawbar, and having a generally flat surface opposite said concave hemispherical buff load bearing surface;

a spool for supporting said drawbar comprising a generally rectangular sleeve to provide a first pair of parallel wall members transverse to a second pair of parallel wall members;

a first pair of axially aligned apertures centrally disposed in said first pair of parallel wall members each adapted to receive an interlocking pin member for pivotally connecting said spool to a support housing;

a second pair of axially aligned apertures centrally disposed in said second pair of parallel wall members, adapted to receive a drawbar pivot pin;

a support housing securable to such center sill of such railway car for supporting said spool, said support housing having a cavity in an outer end adapted to receive said spool, said cavity having axially aligned apertures in opposed side faces thereof, each adapted to receive a said interlocking pin member such that said spool is pivotally attached to said support housing;

a drawbar pivot pin disposed within said second pair of axially aligned apertures in said spool and extending through said generally rectangular aperture through said drawbar;

a bearing block disposed within said generally rectangular aperture in said drawbar having a half-cylindrical surface on one side adapted to engage against said drawbar pivot pin, and a generally flat surface on an opposite side adapted to abut against a side of said rectangular aperture to bias said bearing block against said drawbar pivot pin;

a gravity activated, slack adjusting wedge disposed between said rear support block and a side surface of said cavity in said support housing adapted to bias said rear support block against said convex spherical buff load bearing surface on said drawbar.

15. A slackless drawbar coupler assembly, according to claim 14, in which said aperture in said drawbar is generally rectangular, and a bearing block is provided within said generally rectangular aperture having a half-cylindrical surface on one side adapted to engage against said drawbar pivot pin, and a generally rectangular surface on an opposite side adapted to abut against a flat side surface of said generally rectangular aperture in said drawbar to bias said half-cylindrical surface on said bearing block against said drawbar pivot pin.

16. A slackless drawbar coupler assembly, according to claim 14, in which said gravity activated, slack adjusting wedge is provided with an elastomeric surface on one side surface disposed between said rear support block and a side surface of said cavity in said support housing.

17. A slackless drawbar coupler assembly, according to claim 16, in which said elastomeric surface comprises at least one strip of elastomeric material vulcanized within a vertically disposed recess on the rearward facing surface of gravity wedge, such that the elastomeric strip will be in contact with the flat end wall of said generally rectangular cavity in said support housing.

18. A slackless drawbar coupler assembly, according to claim 16, in which said elastomeric surface comprises at least two, parallel vertical strips of elastomeric material vulcanized within a vertically disposed recess on the rearward facing surface of gravity wedge, such that the elastomeric strip will be in contact with the flat end wall of said generally rectangular cavity in said support housing.

19. A slackless drawbar coupler assembly, according to claim 14, in which said flat surface opposite said concave hemispherical buff load bearing surface is an angled flat surface the angle of which is adapted to mate with an adjacent angled surface on said gravity activated, slack adjusting wedge.

20. A slackless drawbar coupler assembly, according to claim 14, in which said shank portion of said drawbar is hollow and has a generally rectangular cross-section.

* * * * *